US011466540B2

(12) United States Patent
Hunter

(10) Patent No.: US 11,466,540 B2
(45) Date of Patent: Oct. 11, 2022

(54) METHODS AND SYSTEMS FOR A VENT WITHIN A TOOL POSITIONED WITHIN A WELLBORE

(71) Applicant: COMITT WELL SOLUTIONS US HOLDING INC., Katy, TX (US)

(72) Inventor: William Hunter, Houston, TX (US)

(73) Assignee: Comitt Well Solutions LLC, Katy, TX (US)

( * ) Notice: Subject to any disclaimer, the term of this patent is extended or adjusted under 35 U.S.C. 154(b) by 52 days.

(21) Appl. No.: 17/189,486

(22) Filed: Mar. 2, 2021

(65) Prior Publication Data

US 2021/0180432 A1 Jun. 17, 2021

Related U.S. Application Data

(63) Continuation of application No. PCT/US2019/054391, filed on Oct. 3, 2019.

(60) Provisional application No. 62/743,330, filed on Oct. 9, 2018.

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/14; E21B 2200/06; E21B 34/10; E21B 33/12
See application file for complete search history.

(56) References Cited

U.S. PATENT DOCUMENTS

| | | | | |
|---|---|---|---|---|
| 8,757,273 | B2 * | 6/2014 | Themig | E21B 43/14 137/500 |
| 2005/0126776 | A1 * | 6/2005 | Russell | E21B 43/082 166/229 |
| 2018/0073339 | A1 * | 3/2018 | Cleven | E21B 43/25 |
| 2018/0223626 | A1 * | 8/2018 | Wakefield | E21B 34/10 |
| 2019/0292880 | A1 * | 9/2019 | Hunter | E21B 34/10 |

* cited by examiner

*Primary Examiner* — Michael R Wills, III
(74) *Attorney, Agent, or Firm* — Pierson IP, PLLC

(57) ABSTRACT

Systems and methods to maintain constant pressure within a chamber within a tool via a sliding seal, wherein the seal moves to increase or decrease the size of the chamber.

20 Claims, 3 Drawing Sheets

METHODS AND SYSTEMS FOR A VENT WITHIN A TOOL POSITIONED WITHIN A WELLBORE

BACKGROUND INFORMATION

Field of the Disclosure

Examples of the present disclosure relate to systems and methods for a vent positioned within a wellbore. More specifically, embodiments related to a vent through the circumference of the tool positioned below a packer pair that is configured to set based on a pressure differential within a tool.

Background

Hydraulic injection is a method performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases.

To create the sufficient pressure to create fractures straddle packers may be used to isolate an area within the formation. Conventionally, straddle packers are set mechanically or based on a pressure differential between an inner diameter of the tool and an annulus. However, to create the pressure differentially it is typically necessary to create a column of fluid within the tool. To remove the column of fluid within the tool, it is required to reverse circuit fluid through a port positioned between or above the packer pair. This conventional process can take a substantial amount of time, which may shut down a wellbore for a sufficient period of time.

Accordingly, needs exist for systems and methods for fracturing systems with a vent that is positioned below a packer pair that is configured to set based on a pressure differential within the tool.

SUMMARY

Examples of the present disclosure relate to systems and methods utilizing a pressure differential open and close a vent extending through a circumference of the tool. In embodiments, the vent may be positioned below a packer pair, wherein the packer pair extends across an annulus. The tool may include a filter, vent, sliding sleeve, adjustable member, and piston.

The filter may be a passageway that is configured to limit impurities from flowing into a chamber housing the adjustable member. The passageway housing the filter may be positioned between a straddle packer pair, such that the passageway is positioned within an isolated zone. Through the passageway the chamber housing the adjustable member may be in communication with the annulus between the straddle packer pair, such that the chamber has a first pressure that is equal with that of the annulus pressure between the pair of packers.

The vent may include a plurality of orifices positioned proximate to a distal end of the tool, wherein the plurality of orifices extend through a circumference of the tool. The plurality of orifices may be configured to allow communication between an annulus positioned outside of the tool and the inner diameter of the tool. In an open mode, a distal end of the sliding sleeve may be offset from the vent, which allows the vent to be exposed. When exposed, the vent allows for communication between the inner diameter of the tool and the annulus. In a closed mode, the distal end of the sliding sleeve may be aligned with the vent, which may cover the vents and not allow communication between the inner diameter of the tool and the annulus. In embodiments, the vent may be positioned below a packer pair The sliding sleeve may be positioned within the inner diameter of the tool, and may be configured to slide between the proximal end and the distal end of the tool. In embodiments, the sliding sleeve may move towards the distal end of the tool responsive to a pressure differential between the inner diameter of the tool and the annulus between the straddle packer pair being greater than a pressure threshold. When the pressure differential is greater than the pressure threshold, the sliding sleeve may move towards the distal end of the tool and cover the vent. The sliding sleeve may return towards the proximal end of the tool responsive to the pressure differential being less than the pressure threshold, wherein when returning towards the proximal end of the tool the sliding sleeve may uncover the vent. In embodiments, a first end of the sliding sleeve may be configured to be positioned between the straddle packer pair, and the second end of the sliding sleeve may be configured to be positioned below both packers within the packer pair.

The adjustable member may be a spring configured to compress and elongate based on the pressure differential between the inner diameter of the tool and the annulus between the packer pair, wherein the adjustable member may compress when the pressure differential is greater than a spring force and the adjustable member may return to a resting, elongated state, when the pressure differential is less than the spring force. The adjustable member may be configured to be positioned within a chamber that is in communication, via the filter, with an annulus between the straddle packer pair. Responsive to the pressure differential being above a pressure threshold, the adjustable member may compress. Responsive to the pressure differential being below the pressure, the adjustable member may elongate from the compressed state to an elongated state. In embodiments, the pressure differential may be associated with a spring force that is generated by the adjustable member that is a constant force in a direction from the distal end of the tool towards the proximal end of the tool. The adjustable member may be coupled to the sliding sleeve, wherein the sliding sleeve may move responsive to the adjustable member compressing and elongating. When the adjustable member compresses, the sliding sleeve may move towards the distal end of the tool, and when the adjustable member elongates the sliding sleeve may move towards the proximal end of the tool.

The piston may be positioned on a first end of the sliding sleeve. A first diameter across the piston may be greater than a second diameter across the inner diameter of the tool above the piston. This increase in area may be configured to increase the pressure within the inner diameter of tool that is aligned with the piston, which may enable the pressure differential between the piston and the annulus outside of the tool to be greater than the pressure threshold, while the pressure above the piston within the tool may be less than the pressure threshold.

These, and other, aspects of the invention will be better appreciated and understood when considered in conjunction with the following description and the accompanying drawings. The following description, while indicating various embodiments of the invention and numerous specific details thereof, is given by way of illustration and not of limitation.

Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
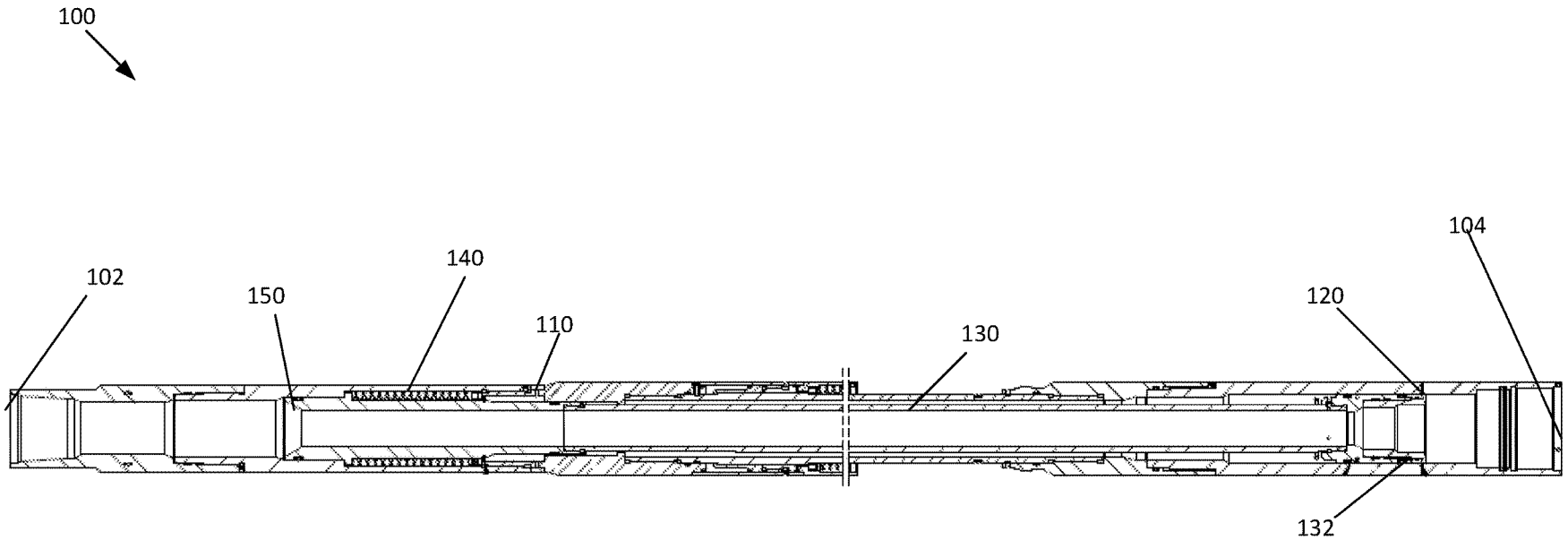
FIG. 1 depicts a tool in a first mode, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a tool 100 in a first mode, according to an embodiment. In the first mode, a vent 120 positioned proximate to a distal end 104 of tool 100 may be uncovered. In embodiments, responsive to generating a pressure differential between the inner diameter of tool 100 and an annulus between a packer pair being greater than a pressure threshold, a sliding sleeve 130 may move to cover the vent 120. By covering vent 120, tool 100 may be configured to generate sufficient pressure within the inner diameter of tool 100 during a stimulation and/or production stage. After the stimulation and/or production stage, vent 120 may be uncovered. By uncovering the vent 120, a pressure differential between the inner diameter of tool 100 and the annulus may quickly and efficiently equalize leading to tool 100 being able to reset quicker. Tool 100 may include a filter 110, vent 120, sliding sleeve 130, adjustable member 140, and piston 150.

Filter 110 may be a passageway that is configured limit impurities from flowing into a chamber housing adjustable member 140. The passageway housing filter 110 may be positioned between a straddle packer pair, such that the passageway is positioned within an isolated zone. A lower straddle packer of the pair may be positioned between filter 110 and vent 120, and an upper straddle packer of the pair may be positioned between filter 110 and a surface of the well. By extending a filter housing securing filter 110 in place 110 from the chamber to the annulus, communication may be enabled between the annulus and the chamber housing adjustable member 140. This may enable the chamber housing adjustable member 140 to have a pressure that is equal to the isolated zone in the annulus between the straddle packer pair.

Vent 120 may include a plurality of orifices positioned proximate to a distal end 104, wherein the plurality of orifices extend through a circumference of tool 100. The plurality of orifices may be configured to allow communication between an annulus positioned outside of the tool at a location below the packer pair and the inner diameter of tool 100. In an open mode, a distal end of sliding sleeve 130 may be offset and positioned above vent 120, wherein the distal end of sliding sleeve is positioned closer to the surface of the well than vent 120. This may allow the plurality of orifices to be exposed, permitting communication between the inner diameter of tool 100 and the annulus. In a closed mode, the distal end of the sliding sleeve 130 may be positioned below vent 120, which may cover the plurality of orifices. This may limit communication between the inner diameter of tool 100 and the annulus.

Sliding sleeve 130 may be positioned within the inner diameter of the tool, and may be configured to slide between the proximal end 102 and the distal end 104 of the tool 100. In embodiments, sliding sleeve 130 may move towards distal end 104 of tool 100 responsive to a pressure differential between the inner diameter of tool 100 and the annulus between the straddle packer paid being greater than a pressure threshold, wherein the pressure threshold is associated with a spring force generated by the adjustable member 140. When the pressure differential is greater than the pressure threshold, sliding sleeve 130 may move towards distal end 104 of the tool and cover vent 120. Sliding sleeve 130 may return towards the proximal end 102 of tool 100 responsive to the pressure differential being less than the pressure threshold, wherein when returning sliding sleeve 130 towards proximal end 102 of tool 100 may uncover the vent 120. In embodiments, a first end of the sliding sleeve 130 may be configured to be positioned between the straddle packer pair, and the second end of sliding sleeve 130 may be configured to be positioned below both packers within the packer pair.

Seal 132 may be configured to be positioned adjacent to and/or below vents 120 when sliding sleeve 130 is moved towards distal end 104 of tool 100. Seal 132 may have a length that is greater than that of a circumference of the plurality of orifices of vent 120. This may limit, restrict, etc. the amount of fluid that can be communicated between the inner diameter of tool 100 and the annulus.

Adjustable member 140 may be configured to compress and elongate based on the pressure differential between the inner diameter of the tool and the annulus between the packer pair. Adjustable member 140 may be configured to be positioned within a chamber that is in communication, via filter 110, with an annulus between the straddle packer pair. In embodiments, the chamber housing the adjustable member 140 may be isolated from the inner diameter of the tool, allowing for a pressure differential to be formed between the inner diameter of tool 100 and the annulus. Responsive to the pressure differential between the inner diameter of the tool and the annulus between the packer pair being above a pressure threshold, adjustable member 140 may compress. Responsive to the pressure differential between the inner diameter of the tool and the annulus between the packer pair being below the pressure, adjustable member 140 may elongate from the compressed state to an elongated state.

In embodiments, the pressure threshold may be associated with a spring force that is generated by adjustable member 140 that is a constant force in a direction from distal end 104 of tool 100 towards the proximal end 102 of tool 100. Adjustable member 140 may be coupled to the sliding sleeve 130, wherein sliding sleeve 130 may move responsive to adjustable member 140 compressing and elongating. When the adjustable member compresses, the sliding sleeve 130 may move towards the distal end of the tool, and when the adjustable member elongates the sliding sleeve 130 may move towards the proximal end of the tool.

Piston 150 may be positioned on a first end of sliding sleeve 130. A first diameter across the piston may be greater than a second diameter across the inner diameter of the tool above piston 150. This increase in area may be configured to increase the pressure within the inner diameter of tool that is aligned with piston 150, which may enable the pressure differential between the piston and the annulus outside of the tool to be greater than the pressure threshold associated with the spring force.

Figure 2:
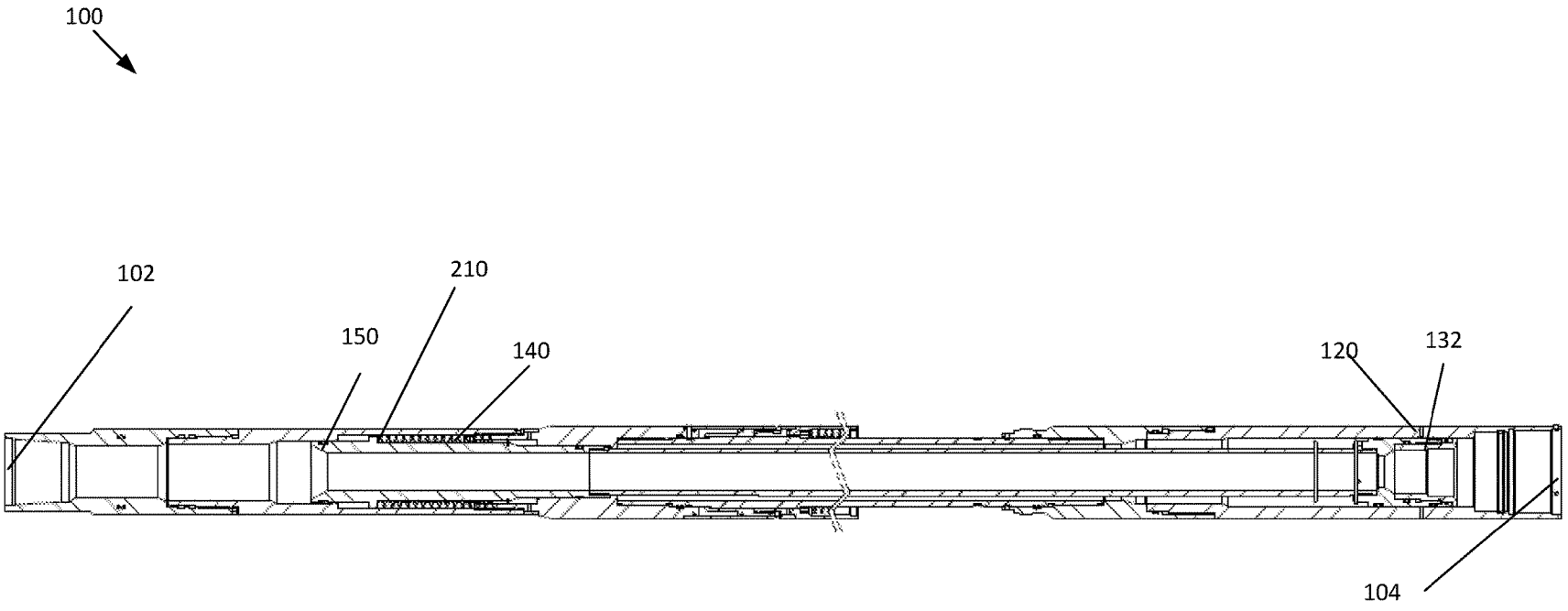
FIG. 2 depicts a tool in a second mode, according to an embodiment.

FIG. 2 depicts tool 100 in the second mode, according to an embodiment. Elements depicted in FIG. 2 may be substantially similar to those described above. Therefore, for the sake of brevity a further description of these elements is omitted.

In the second mode, sliding sleeve 130 may have moved towards distal end 104 based on the pressure differential within the annulus between the packer pair and the inner diameter of tool 100 being greater than the spring force applied by adjustable member 140 in an opposite direction. Based on the pressure differential increasing, a ledge 210 on sliding sleeve 140 may apply forces in a direction towards distal end 104 to compress adjustable member 140.

Responsive to moving sliding sleeve 130, vent 120 may be covered by sliding sleeve 130 and sealed. This may allow for a production stage within the isolated zone between the packer pair, while not allowing for communication with an annulus through vent 120.

In embodiments, the pressure differential may increase to be greater than the pressure threshold responsive to flowing fluid through the inner diameter of the tool 100 to set the pair of packers, wherein the pressure increases within the inner diameter of the tool 100 after the zone has been isolated. When the flow of fluid ceases through the inner diameter of tool 100, the annulus between the packer pair and the inner diameter of the tool may have equalized pressure, which enables the spring force to be greater than the pressure differential. This may enable tool 100 to reset, moving sliding sleeve 130 towards proximal end 102, and uncovering vent 120.

Figure 3:
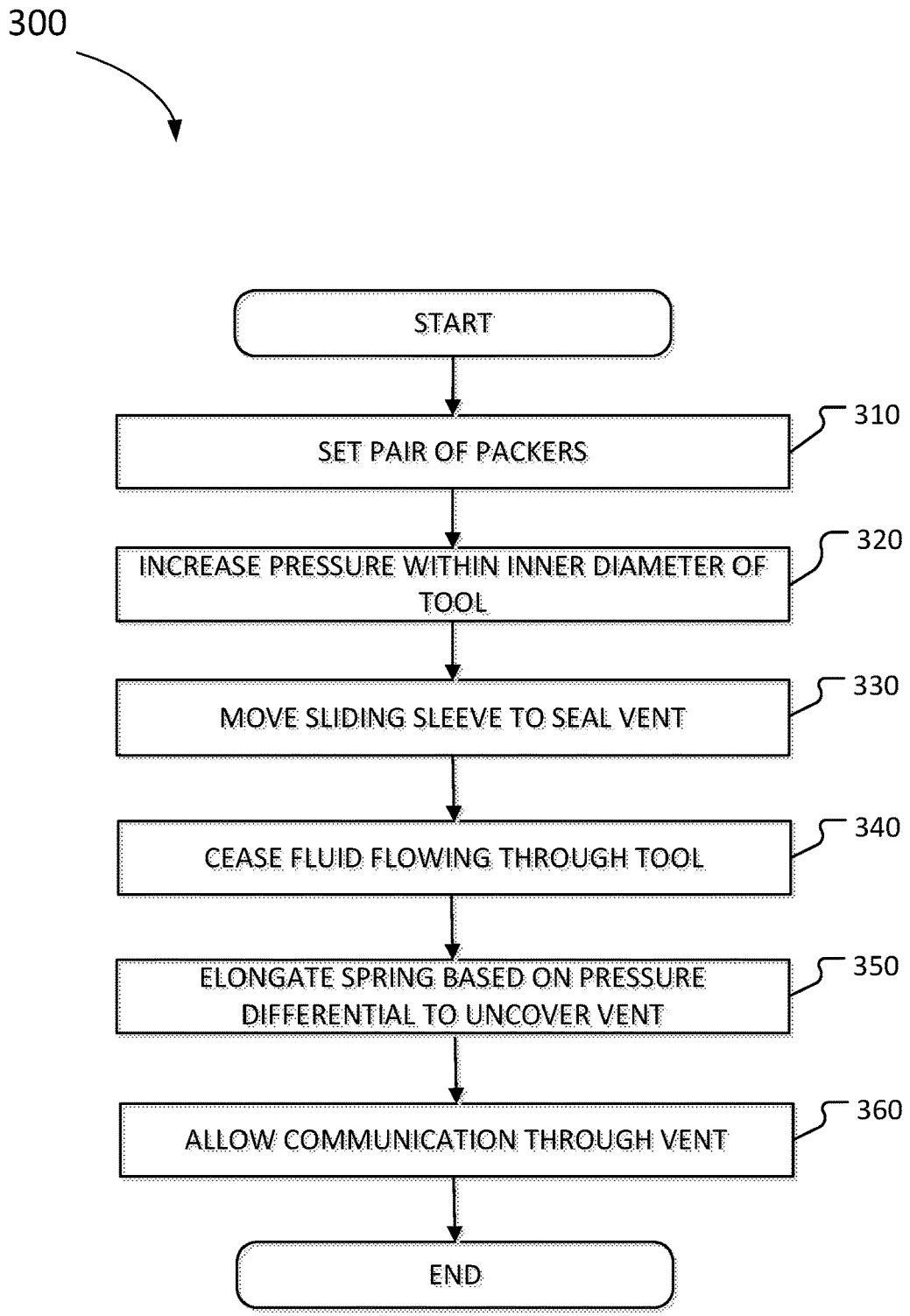
FIG. 3 depicts a method for utilizing a tool, according to an embodiment.

FIG. 3 depicts a method 300 for a system utilizing pressure differential to open and close a vent, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. Furthermore, the operations of method 300 may be repeated for subsequent valves or zones in a well.

At operation 310, a fluid flow rate through the inner diameter of a tool may increase, which may cause a pair of straddle packers to set.

At operation 320, a pressure differential between an annulus between the packer pair and the inner diameter of the tool may increase to be greater than a spring force in a second direction.

At operation 330, the pressure differential may cause a ledge on a sliding sleeve to compress the spring, and allow the sliding sleeve to move towards a distal end of the tool. Responsive to the sliding sleeve moving, the sliding sleeve may cover a vent.

At operation 340, fluid may cease flowing through the inner diameter of the tool, allowing the pressure within the annulus and the inner diameter of the tool to decrease to be less than the spring force.

At operation 350, the spring force may elongate and apply pressure against the ledge of the sliding sleeve. This may cause the sliding sleeve to move towards the proximal end of the tool and uncover the vent.

At operation 360, fluid may be communicated between the annulus and the inner diameter of the tool at a location below the packer pair. This may allow the packer pair to reset more efficiently and also allow pressures between the inner diameter of the tool and the annulus to more quickly equalize.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for a downhole tool comprising:

a chamber configured to house a spring, the spring being configured to elongate and compress;

a housing configured to house a filter, the housing having a first end opening exposed to the chamber and a second end opening exposed to a first zone of an annulus, the chamber having a same pressure as the first zone of the annulus, wherein the housing is configured to allow communication between the first zone of the annulus and the chamber;

a vent positioned outside of the first zone of the annulus, the vent having a first vent opening exposed to an inner diameter of the downhole tool and a second vent opening exposed to a second zone of the annulus, the second zone of the annulus being configured to be isolated from the first zone of the annulus;

a sliding sleeve configured to slide to cover and uncover the vent based in part on a pressure differential between the inner diameter of the downhole tool and the first zone of the annulus.

2. The system of claim 1, wherein the spring is configured to apply a constant force in a direction from a distal end of the downhole tool towards a proximal end of the downhole tool.

3. The system of claim 2, wherein the sliding sleeve is configured to move towards the distal end of the downhole tool to cover the vent responsive to the pressure differential being greater than a pressure threshold.

4. The system of claim 3, wherein the pressure threshold is associated with the constant force.

5. The system of claim 3, wherein the sliding sleeve is configured to move away from the distal end of the downhole tool to uncover the vent responsive to the pressure differential being less than the pressure threshold.

6. The system of claim 5, wherein the first zone of the annulus is isolated from the second zone of the annulus before the sliding sleeve moves to cover the vent.

7. The system of claim 6, wherein the sliding sleeve uncovers the vent before the first zone of the annulus is in communication with the second zone of the annulus.

8. The system of claim 1, further comprising:

a piston positioned on a first end of the sliding sleeve, a first diameter across the piston being greater than a second diameter across the inner diameter of the downhole tool above the piston.

9. The system of claim 8, wherein the piston assists in creating the pressure differential.

10. The system of claim 9, wherein the sliding sleeve includes a ledge with a lower surface configured to receive forces from the spring, and an upper surface of the ledge is configured to be the piston.

11. A method associated with for a downhole tool comprising:

positioning a spring within a chamber, the spring being configured to elongate and compress;

positioning a filter within a housing, the housing having a first end opening exposed to the chamber and a second end opening exposed to a first zone of an annulus, the chamber having a same pressure as the first zone of the annulus, wherein the housing allows communication between the first zone of the annulus and the chamber;

positioning a vent outside of the first zone, the vent having a first vent opening exposed to an inner diameter of the downhole tool and a second vent opening exposed to a second zone of the annulus, the second zone of the annulus being configured to be isolated from the first zone of the annulus;

moving a sliding sleeve to cover and uncover the vent based in part on a pressure differential between the inner diameter of the downhole tool and the first zone of the annulus.

12. The method of claim 11, further comprising:

applying a constant force via the spring in a direction from a distal end of the downhole tool towards a proximal end of the downhole tool.

13. The method of claim 12, further comprising:

moving the sliding sleeve towards the distal end of the downhole tool to cover the vent responsive to the pressure differential being greater than a pressure threshold.

14. The method of claim 13 wherein the pressure threshold is associated with the constant force.

15. The method of claim 14, further comprising:

moving the sliding sleeve away from the distal end of the downhole tool to uncover the vent responsive to the pressure differential being less than the pressure threshold.

16. The method of claim 15, wherein the first zone of the annulus is isolated from the second zone of the annulus before the sliding sleeve moves to cover the vent.

17. The method of claim 16, wherein the sliding sleeve uncovers the vent before the first zone of the annulus is in communication with the second zone of the annulus.

18. The method of claim 11, further comprising:

forming a piston on a first end of the sliding sleeve, a first diameter across the piston being greater than a second diameter across the inner diameter of the downhole tool above the piston.

19. The method of claim 18, wherein the piston assists in creating the pressure differential.

20. The method of claim 19, further comprising: wherein the sliding sleeve includes a ledge;

receiving forces on a lower surface of the ledge from the spring, and an upper surface of the ledge is configured to be the piston.

* * * * *